United States Patent [19]

Gazzarrini

[11] Patent Number: 4,564,133

[45] Date of Patent: Jan. 14, 1986

[54] APPARATUS AND METHOD FOR RAPID LOADING OF PANTYHOSE ONTO A STOCKING FINISHING MEDIUM

[75] Inventor: Vinicio Gazzarrini, Florence, Italy

[73] Assignee: Solis s.r.l., Florence, Italy

[21] Appl. No.: 651,664

[22] Filed: Sep. 17, 1984

[30] Foreign Application Priority Data

Sep. 19, 1983 [IT] Italy ..... 9517 A/83

[51] Int. Cl.[4] ..... A41H 43/02

[52] U.S. Cl. ..... 223/39; 223/43; 223/75

[58] Field of Search ..... 223/43, 75, 76, 77, 223/39, 60, 40, 41, 42, 72

[56] References Cited

U.S. PATENT DOCUMENTS

| | | | |
|---|---|---|---|
| 3,097,770 | 7/1963 | Garrou | 223/75 X |
| 4,381,068 | 4/1983 | Raisin et al. | 223/43 X |
| 4,434,918 | 3/1984 | Hodges | 223/75 |
| 4,487,546 | 12/1984 | Cassinelli | 223/41 X |

FOREIGN PATENT DOCUMENTS

| | | | |
|---|---|---|---|
| 2366025 | 5/1977 | Fed. Rep. of Germany | 223/43 |
| 2417577 | 10/1979 | France | 223/39 |

*Primary Examiner*—Louis K. Rimrodt

*Attorney, Agent, or Firm*—McAulay, Fields, Fisher, Goldstein & Nissen

[57] ABSTRACT

Apparatus for rapid loading of pantyhoses onto a stocking finishing medium having a pneumatic reversing mechanism including two tubes for receiving the legs of the pantyhoses. The apparatus includes a carrousel structure including at least two intermittently rotating radially arranged arms, each of the arms including a support for a panty portion of the pantyhoses, prongs to engage an elastic edge portion of the panty portion for opening thereof and stretching it into a generally rectangular configuration, removing the panty portion from the support and superimposing the panty portion on the tubes, then reversing the panty portion thereon while the pneumatic reversing mechanism draws the legs into the tubes. A track extends radially from the center of the carrousel towards the outer periphery thereof, and a carriage moves the prongs with the pantyhose thereon from the support to the tubes.

20 Claims, 12 Drawing Figures

APPARATUS AND METHOD FOR RAPID LOADING OF PANTYHOSE ONTO A STOCKING FINISHING MEDIUM

BACKGROUND OF THE INVENTION

1. Field of the Invention

This invention is concerned with an apparatus for the rapid loading of pantyhose onto a stocking finishing medium which is specially equipped with a pneumatic reversing mechanism, and a method therefor.

2. Description of the Prior Art

Machines for finishing stockings, such as those for sewing the toe portions, are known to make use of a pneumatic reversing mechanism with several horizontal parallel tubes projecting from a vertically intermittently rotating drum and arranged opposite to the vertices of a polygon, so that each pair of contiguous tubes can be used to receive a reversed panty portion of a pantyhose so that the legs of the pantyhose which were previously drawn into the tubes can subsequently be reversed onto the tubes.

It is also known that the loading of the pantyhose onto the reversing mechanism of the machines for sewing the toes of pantyhose is a manual operation which is carried out or performed manually by stretching the elastic edge of the panty portion and reversing the pantyhose, and further, by bringing the legs of the pantyhose close to the mouths of two contiguous tubes in the reversing mechanism to assure that the legs are drawn inside of the two contiguous tubes.

These operations in themselves are generally very simple, but since such operations must be repeated a very large number of times, considerable and constant attention on the part of the operator for carrying out such operations is required. This constant attention is required so that the loading rate never reaches the toe-sewing rate of the toe-sewing machine.

SUMMARY OF THE INVENTION

The principle purpose of the present invention is to remedy the aforedescribed drawback.

This result is achieved, according to the teachings of the invention, by adopting the idea and concept of manually slipping the panty of the pantyhose straight onto two flat shapes, which are contiguous and capable of being aligned with the two tubes in the pneumatic reversing mechanism of a stocking finishing machine, in their loading position; then, mechanically stretching the elastic edge of the panty to enable it to be removed from the two flat shapes; and finally, transferring the panty is such stretched configuration, causing it to be automatically reversed onto the two adjacent or contiguous tubes in the reversing mechanism located at the loading station, which is assisted by the drawing of the pantyhose legs into the tubes of the reversing mechanism.

After considering the detailed description of the invention and the operation thereof, it will be evident to those skilled in the art that the manual loading operation is considerably simplified and shortened, thereby helping to relieve operator fatigue. With the teachings of the present invention, it has been ascertained that the transfer of the pantyhose onto the reversing mechanism can take place in the same time as the sewing of the toes of the two stockings and, in some instances, even in a shorter time. The operation is satisfactory and has a high degree of reliability, even after a long period of operation.

These and further advantages and features of the invention will be more fully and better understood by any expert in the field from the following detailed description of the best mode for carrying out the invention, and with the aid of the attached drawings, which illustrate a practical embodiment of the invention, but it is not to be regarded as limiting the scope of the invention.

To these ends, the present invention consists in the provision of apparatus for rapid loading of pantyhoses onto a stocking finishing medium having a pneumatic reversing mechanism including two tubes for receiving the legs of the pantyhoses, in which a carrousel structure is provided including at least two intermittently rotating radially arranged arms, each of the arms including means comprising two shapes for supporting a panty portion of the pantyhoses straight; means for engaging an elastic edge portion of the panty portion for opening thereof and stretching it into a generally rectangular configuration, removing the panty portion from the supporting means and superimposing the panty portion on the tubes and reversing the panty portion thereon while the pneumatic reversing mechanism draws the legs into the tubes; and track means extending radially from the center of the carrousel towards the outer periphery thereof, and including means for moving the engaging means with the pantyhose thereon from the support means to the tubes.

Each of the supporting means includes two flat elements lying side by said in the same horizontal plane, each flat element includes a longer member and a shorter member. The longer member has one end fixed to the carrousel for rotation therewith and a free end; and the shorter member is connected to an outer portion between the extremities of the longer member and has one end tapered toward the free end but short thereof.

The engaging means includes a pair of spaced opening devices each comprising two horizontal prongs for engaging the elastic edge portion. At least one of the horizontal prongs is movable, and pneumatic means is coupled with each movable prong for imparting alternating vertical motion thereto.

The moving means includes a carriage along the track means which extends from the carrousel above the pneumatic receiving means to permit vertical movement of the engaging means relative to the pneumatic means free of interference therebetween. Additional engaging means juxtaposed to the pneumatic reversing mechanism is provided for gripping the elastic edge portion of the panty portion to permit the firstmentioned engaging means to be released from the elastic edge portion. Hooks are provided at the tubes for engaging the elastic edge portion to permit the horizontal prongs to be released from the elastic edge portion and return thereof towards the carrousel structure.

The invention is also concerned with a method for rapid loading of pantyhose having leg portions and a panty portion with an elastic edge onto a stocking finishing machine at a loading station thereof with a pneumatic reversing device having tubes, which comprises the steps of: applying the panty portion on two flat contiguous shapes; aligning the two flat shapes with two contiguous tubes of the pneumatic reversing device; stretching the elastic edge for opening thereof and removing the panty portion from the two shapes in its stretched condition; and transferring the panty portion in its stretched condition to the two tubes and reversing the panty portion on the two tubes while the leg portion are pneumatically drawn into the tubes by pneumatic means. The elastic edge is opened and stretched by engaging thereof with two opening devices each having a pair of horizontal prongs and then the elastic edge is formed into a stretched rectangularly-shaped configuration. The panty is transferred by means of a carriage to a position above the tubes to permit the opening devices to be operated, and the panty portion is then superimposed onto the pneumatic device and then the panty portion is reversed onto the tubes while the pneumatic device draws the legs into the tubes, after which the opening devices are released from the elastic edge.

DESCRIPTION OF BEST MODE AND PREFERRED EMBODIMENT

Figure 1:
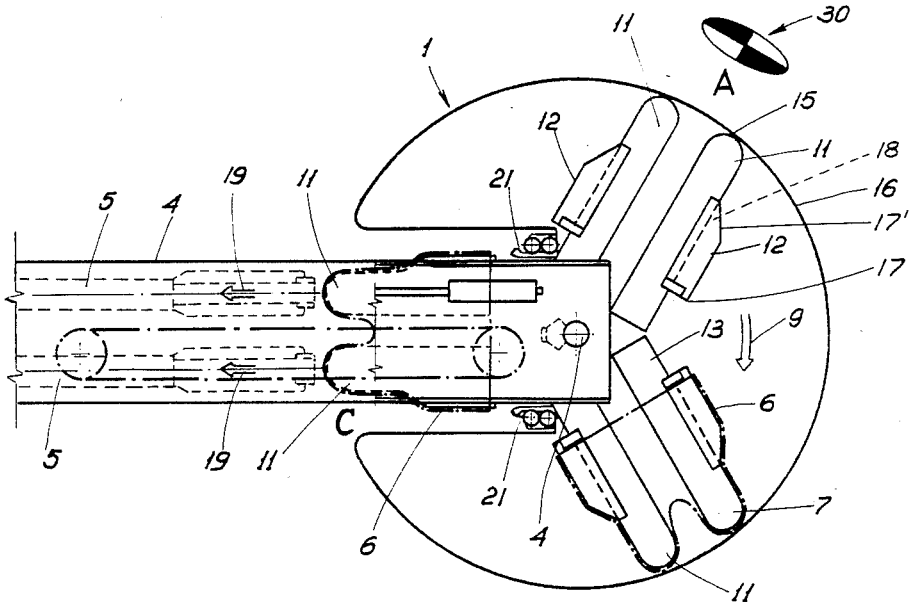
FIG. 1 shows a plan view of an apparatus according to the invention.
Figure 4:
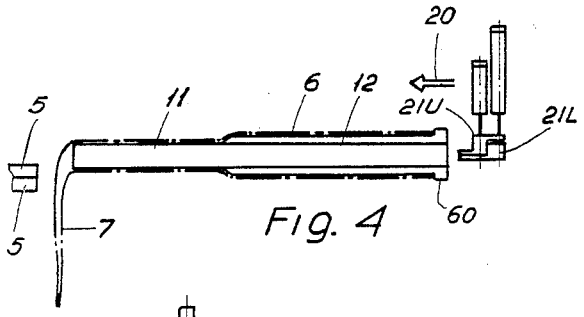
FIG. 4 shows a side view of an enlarged detail of an arm of the apparatus of FIG. 1, with the pantyhose just slipped onto the shapes; opening devices are at the end of their return run and start their forward run.
Figure 5:
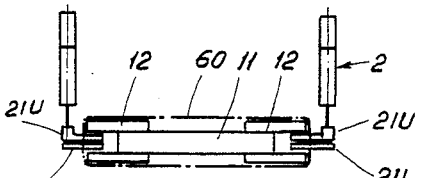
FIG. 5 shows a front view of the detail of FIG. 4.

Referring now to the drawings, and in particular to FIG. 1, a carrousel structure 1 is shown onto which a pantyhose 30, schematically shown, is to be placed. Carrousel structure 1 is shown juxtaposed to two opening devices 2 on a carriage 3 which rides on a track 4 for transferring the pantyhose 30 in the direction of arrows 19 (FIG. 1) from carrousel 1 to tubes 5 forming part of pneumatic suction devices located at a loading station of a stocking finishing machine. The details of the stocking finishing machine are not shown because it forms no part of the invention.

Carrousel structure 1 is shown as provided with three radial arms 10, each of which arms is equipped with two identical flat shapes 11, and lie in the same horizontal plane, placed side-by-side and appropriately spaced. While three radial 10 arms are shown, it is possible to provide two or four, depending on the speed of operation. The radial arms 10 are preferably equi-angular spaced relative to each other on the carrousel. Shape 11 has one end 13 fixed near the center of rotation of the carrousel on axle or post 14 and its other end 15 free and curved and extending to the outer rim 16 of the carrousel. Carrousel 1 rotates clockwise as shown in the direction of arrow 9.

From the outer side of each shape 11 there projects a straight sector 12, having one end 17 spaced from post 14 and its other end 17' tapered toward the free end 15 of the shape 11 and with its longitudinal edge externally grooved at 18.

Reference letter A indicates a pantyhose applying station on the carrousel and reference letter C indicates an unloading or removal station which is aligned with the loading station of the stocking finishing machine. Known means are provided to cause the carrousel to rotate intermittently and clockwise, with the shapes 11 stopping in front of and aligned with the two corresponding tubes 5 in the pneumatic reversing mechanism of the stocking finishing machine, at the loading station. A third radial arm is shown positioned between the radial arms at stations A and C, and this is shown with the panty portion 6 thereon being transported from loading station A to unloading station C of the carrousel.

Positioned above carrousel 1 (see FIGS. 2 and 3) and supported by post 14 is a track 4 extending from unloading station C and extending to the loading station of tubes 5 of the stocking finishing machine for carrying a carriage 3 which moves along the tracks 4 between the carrousel and the stocking finishing machine for carrying a pair of opening devices 2.

Referring now in detail to FIGS. 4 to 12, the pair or two opening devices 2 are provided for opening of the panty portion 6 by engaging the elastic edge 60 thereof after the panty 6 of the pantyhose 30 is slipped onto the shapes 11 of the arms of the carrousel. Each of the devices 2 is equipped with two independent horizontal prongs generally designated 21, one above the other, rotating horizontally and with the lower prong 21L moving vertically by pneumatic operation of pneumatic device 22. The opening devices 2 are mounted externally on the sides of the carriage which is moved along the straight horizontal track 4, which projects radially from the center of carrousel 1 as far as is necessary to reach above the radial arms 10 of the carrousel and above two tubes 5 of a pneumatic reversing mechanism located at the loading station and aligned with the arm 10 at the unloading station C. Prong 21U is held stationary in the vertical direction, but could be made moveable.

Figure 2:
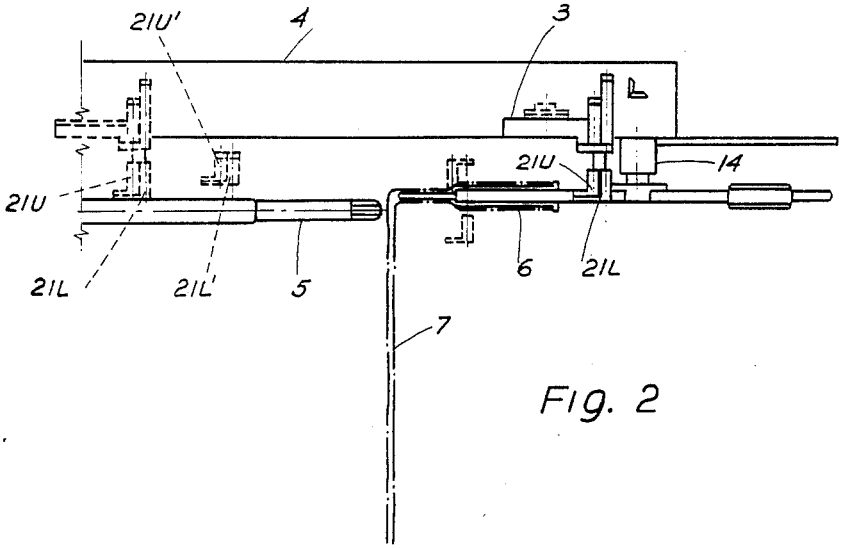
FIG. 2 shows a partial side view of the apparatus of FIG. 1.
Figure 3:
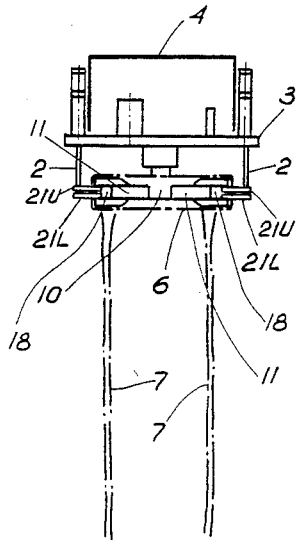
FIG. 3 shows a partial front view of the apparatus of FIG. 2.

Prongs 21U and 21L forming part of opening devices 2 are shown in dashed outline in FIG. 2 and are designaed 21U' and 21L' to show the position of the prongs 21 during return of the carriage along the straight horizontal track 4. The dashed outline of 21U and 21L are shown at the end of the run on the horizontal track 4 and show the position of the opening devices 2 at the end of the run.

DESCRIPTION OF THE INVENTION

In order to rapidly load pantyhose onto the stocking finishing machine, which is specially equipped with a pneumatic reversing mechanism, use is made of the carrousel with several horizontal arms 10 which are positioned to lie on the same plane as the tubes 5 of the reversing mechanism in their loading position. Carrousel 1 is capable of rotating intermittently with a stop in position on top of and aligned with tubes 5 in the reversing mechanism. Each arm 10 in the carrousel is equipped with the two flat shapes 11 to support the panty 6 of the pantyhose onto tubes 5 of the reversing mechanism, while the legs 7 of the pantyhose are drawn into the tubes 5. A horizontal track 4 extends above the tubes 5 of the reversing mechanism in their loading position to make it possible to operate the opening devices 2.

At carrousel station A, the panty 6 of the pantyhose 30 is slipped completely and straight around the two adjacent shapes 11 and the two sectors 12 of each arm 10 as it reaches station A. Then, the carrousel proceeds to transfer the pantyhose 30 to station C. At station C, the two opening devices 2, which are at the end of their return run (see FIG. 4) start their forward run in the direction of arrow 20 towards the tubes 5 of the reversing mechanism, and the elastic edge 60 is engaged by the prongs 21, which are oriented transversely relative to the direction of their motion, and those of one device 2 on one side of carriage 3 are aligned with those of the other device 2 on the other side of carriage 3. The elastic edge 60 of the panty 6 is gripped by the opening devices which proceed gradually to remove the panty 6 from the shapes 11.

Figure 6:
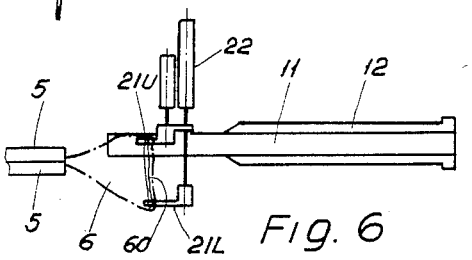
FIG. 6 shows a side view of the devices to catch the panty of the pantyhose during its removal from the shapes.
Figure 7:
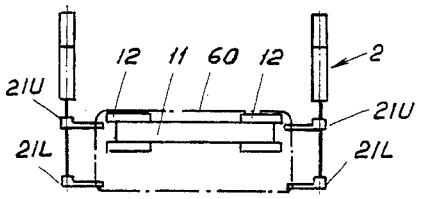
FIG. 7 shows a front view of the detail of FIG. 6.
Figure 8:
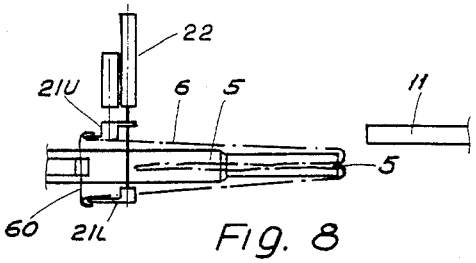
FIG. 8 shows a side view of the devices to catch the panty of the pantyhose during its transfer and reversal onto two tubes of a pneumatic reversing mechanism.
Figure 9:
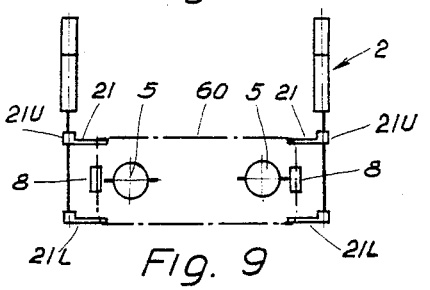
FIG. 9 shows a front view of the detail of FIG. 8.
Figure 10:
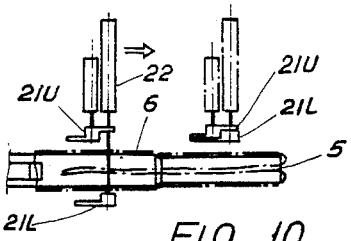
FIG. 10 shows a side view of the detail of the devices to catch the panty of the pantyhose with the pantyhose transferred onto the pneumatic reversing mechanism.
Figure 11:
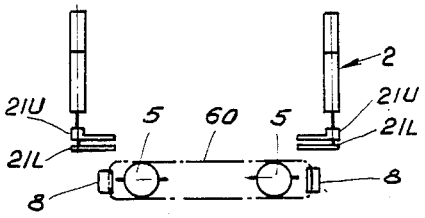
FIG. 11 shows a front view of the detail of FIG. 10.
Figure 12:
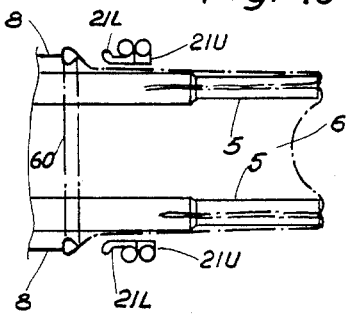
FIG. 12 shows a plan view of the detail of FIG. 10.

As soon as the carriage 3 which carries the opening devices 2 reaches the narrower area of the arms 10 beyond the area of straight sector 12, the vertically moveable lower prongs 21L of the opening devices 2 are lowered, thereby causing the elastic edge 60 of the panty of the pantyhose to be stretched open into a rectangle or a generally rectangular configuration (see FIG. 7), and in that configuration the panty 6 and prongs 21 continue their forward run while the legs 7 of the pantyhose 30 are drawn into the corresponding tubes 5 of the reversing mechanism (see FIG. 6).

After the panty 6 has been completely removed from the shapes 11, the opening devices 2 move externally along the two tubes 5 of the reversing mechanism while the legs 7 continue to be pneumatically drawn into the tubes 5 by means of a pneumatic device associated therewith and schematically shown as forming part of tubes 5. This makes it possible to place the panty over the tubes 5 and reverse the panty 6 of the pantyhose around the tubes 5 (see FIG. 8). At the end of the forward run, the elastic edge 60 of the pantyhose is engaged by two hooks 8, to enable two opening devices 2 to release the elastic edge 60 and to reverse their run, so that the panty 6 is left by itself and is wrapped around the two tubes 5 of the reversing mechanism (see FIGS. 11 and 12), as is the case after manual loading.

At the end of the return run, the two opening devices 2 now find at carrousel station C the next following arm 10, on whose shapes 11 another pantyhose 30 has been slipped, and the operations as described above are repeated.

While reference nuemral 30 has been applied to a pantyhose, it can also represent a symbolic operator who would place the pantyhose onto the two identical flate shapes 11.

In practice, the details of the embodiment may in any case vary equally in shape, size, arrangement of the components, nature of the materials used, without, however, exceeding the scope of the idea adopted as a solution, and therefore remaining within the scope of the protection granted.

While there has been shown and described what is at present considered the preferred mode for carrying out the invention, it will be obvious to those skilled in the art that various changes and modifications may be made therein without departing from the scope of the invention.

What is claimed is:

1. Apparatus for rapid loading of pantyhoses onto a stocking finishing machine having a pneumatic reversing mechanism including two tubes for receiving the legs of the pantyhose, comprising:

a carrousel structure including at least two intermittently rotating radially arranged arms, each of said arms including means for supporting a panty portion of the pantyhoses;

means for engaging an elastic edge portion of the panty portion for opening thereof and stretching it into a generally rectangular configuration, removing the panty portion from said supporting means and superimposing the panty portion on said tubes and reversing the panty portion thereon while said pneumatic reversing machanism draws the legs into said tubes;

track means extending radially from the center of said carrousel towards the outer periphery thereof; and means for moving said engaging means with the pantyhose thereon from said supporting means to said tubes.

2. Apparatus according to claim 1, wherein said supporting means includes two shapes for supporting the panty portion straight.

3. Apparatus according to claim 1, wherein each said supporting means includes two flat elements lying side by side in the same horizontal plane, each said flat element includes a longer member and a shorter member, said longer member having one end fixed to said carrousel for rotation therewith and a free end, said shorter member being connected to an outer portion between the extremities of said longer member and having one end tapered toward said free end but short thereof.

4. Apparatus according to claim 1, wherein said engaging means includes a pair of spaced opening devices each comprising two horizontal prongs for engaging the elastic edge portion.

5. Apparatus according to claim 4, wherein at least one of said horizontal prongs is vertically movable, and pneumatic means coupled with each said movable prong for imparting alternating vertical motion thereto.

6. Apparatus according to claim 4, including hooks at said tubes for engaging the elastic edge portion to permit said horizontal prongs to be released from the elastic edge portion and return thereof towards said carrousel structure.

7. Apparatus according to claim 1, wherein said supporting means includes two shapes for supporting the panty portion straight, each said shape includes a first elongated member having one end fixed to said carrousel and its other end free, and a second shorter member having one end fixed approximately midway between the ends of said first member and its other end tapered toward the free end of said first member but terminating before the free end thereof.

8. Apparatus according to claim 1, wherein said moving means includes a carriage along said track means.

9. Apparatus according to claim 1, wherein said track means extends from said carrousel above said pneumatic receiving means to permit vertical movement of said engaging means relative to said pneumatic means free of interference therebetween.

10. Apparatus according to claim 1, including additional engaging means juxtaposed to said pneumatic reversing mechanism for gripping the elastic edge portion of the panty portion to permit said first-mentioned engaging means 11. Apparatus for rapid loading of pantyhoses having legs and a panty portion with an elastic edge onto a stocking finishing machine including a pneumatic reversing mechanism provided at a loading station thereof with two tubes for receiving the legs, comprising:

a carrousel structure including at least two radially arranged intermittently rotating horizontal arms and means for rotating said arms for stopping at an applying station for loading the pantyhose onto one of said arms and stopping at a transfer station aligned with said loading station for transferring the pantyhose to said pneumatic reversing mechanism, each of said arms including two shapes for supporting the panty portion;

a pair of spaced opening devices each including two horizontal prongs, one lower than the other, for engaging the elastic edge to open it and for stretching thereof into a rectangular configuration;

means associated with each of said opening devices for removal of the panty portion from said two shapes for superimposing the panty portion and reversing thereof onto said tubes while said pneumatic reversing mechanism draws the legs into said tubes; and a straight horizontal track extending from the center of said carrousel towards the outside thereof above said tubes at said loading station to permit operation of said opening devices.

12. Apparatus according to claim 11, wherein each of said shapes comprise two flat elements lying in the same plane and a straight sector member on the outside of each of said flat elements, each of said flat elements having an end fixed to said carrousel and a free end, said straight sector being shorter in axial length than said flat element and having one end extending proximately from said fixed end and its other end tapering towards said free end.

13. Apparatus according to claim 12, wherein said two flat elements are laid side by side next to each other but spaced sufficiently to engage the panty portion with said straight sector.

14. Apparatus according to claim 11, including a carriage movable along said track, and said opening devices being carried by said carriage.

15. Apparatus according to claim 11, including a pneumatic cylinder for each of said lower prongs for imparting thereto alternating vertical motion.

16. Method for rapid loading of pantyhoses having leg portions and a panty portion with an elastic edge onto a stocking finishing machine at a loading station thereof with a pneumatic reversing device having tubes, comprising the steps of:

applying the panty portion on two flat contiguous shapes;

aligning of two flat shapes with two contiguous tubes of the pneumatic reversing device;

stretching the elastic edge for opening thereof and removing the panty portion from the two shapes in its stretched condition; and transferring the panty portion in its stretched condition to the two tubes and reversing the panty portion on the two tubes while the leg portions are pneumatically drawn into the tubes by pneumatic means.

17. Method according to claim 16, wherein the two flat contiguous shapes are carried by a carrousel having at least two radially aligned intermittently rotating arms, each of which carries a pair of the flat contiguous shapes, and the panty portion is applied to the pair of contiguous shapes at an applying station.

18. Method according to claim 17, wherein the panty portion after movement thereof to a transferring station by the carrousel is transferred thereon on a carriage to the pneumatic device at the loading station of the stocking finishing machine.

19. Method according to claim 16, wherein the elastic edge is opened and stretched by engaging thereof with two opening devices each having a pair of horizontal prongs and forming the elastic edge into a stretched rectangularly-shaped configuration.

20. Method according to claim 16, wherein the panty is transferred by means of a carriage to a position above the tubes to permit the opening devices to be operated, and superimposing the panty portion onto the pneumatic device and reversing the panty portion onto the tubes while the pneumatic device draws the legs into the tubes, and then releasing the opening devices from the elastic edge.

* * * * *

UNITED STATES PATENT AND TRADEMARK OFFICE

CERTIFICATE OF CORRECTION

PATENT NO. : 4,564,133

DATED : Jan. 14, 1986

INVENTOR(S) : Vinicio Gazzarrini

It is certified that error appears in the above-identified patent and that said Letters Patent is hereby corrected as shown below:

Column 2, line 32, "side bv said" should read -- side by side --.

Column 2, line 59, "Pantyhose" should read -- Pantyhoses --.

Column 4, lines 47-48, "designaed" should read -- designed --.

Column 5, line 52, "nuemral" should read -- numeral --.

Column 6, line 4, "pantyhose" should read -- pantyhoses --.

Column 6, line, 15, "machanism" should read -- mechanism --.

Column 6, line 68, add -- to be released from the elastic edge portion --, after "engaging means"

Column 8, line 11, "aligning of two" should read -- aligning the two --.

Signed and Sealed this

Fourteenth Day of October, 1986

[SEAL]

*Attest:*

DONALD J. QUIGG

*Attesting Officer*

*Commissioner of Patents and Trademarks*